US011285520B2

(12) United States Patent
McDonald et al.

(10) Patent No.: US 11,285,520 B2
(45) Date of Patent: Mar. 29, 2022

(54) DRAIN LINE CLEANING SYSTEM

(71) Applicants: Robert Cody McDonald, Melbourne Beach, FL (US); Robert Bruce McDonald, Melbourne Beach, FL (US); Teresa King, Melbourne Beach, FL (US)

(72) Inventors: Robert Cody McDonald, Melbourne Beach, FL (US); Robert Bruce McDonald, Melbourne Beach, FL (US); Teresa King, Melbourne Beach, FL (US)

( * ) Notice: Subject to any disclaimer, the term of this patent is extended or adjusted under 35 U.S.C. 154(b) by 0 days.

(21) Appl. No.: 16/885,847

(22) Filed: May 28, 2020

(65) Prior Publication Data

US 2021/0370361 A1 Dec. 2, 2021

(51) Int. Cl.
*B08B 9/032* (2006.01)
*E03C 1/304* (2006.01)

(52) U.S. Cl.
CPC ..... *B08B 9/0325* (2013.01); *B08B 9/0323* (2013.01); *E03C 1/304* (2013.01)

(58) Field of Classification Search
CPC ..... B08B 9/027; B08B 9/032; B08B 9/0321; B08B 9/0325; B08B 9/0326; B08B 9/0328; B08B 2209/032; E03C 1/304; E03C 1/308; F24F 2013/227; F24F 2221/22; F24F 2221/225
See application file for complete search history.

(56) References Cited

U.S. PATENT DOCUMENTS

| | | | | |
|---|---|---|---|---|
| 3,667,487 | A * | 6/1972 | Schoenbeck | B08B 9/0326 134/108 |
| 5,416,947 | A * | 5/1995 | Jaffe | B08B 9/0326 15/406 |
| 6,142,170 | A * | 11/2000 | Belter | B08B 9/0325 137/240 |
| 6,487,867 | B1 * | 12/2002 | Herren | B08B 9/08 62/126 |
| 7,392,658 | B1 | 7/2008 | Hardy, III | |
| 8,646,474 | B2 | 2/2014 | Pearson | |
| 9,372,036 | B2 | 7/2016 | Pearson | |
| 10,006,656 | B1 * | 6/2018 | Parks | F24F 13/222 |
| 10,610,907 | B1 * | 4/2020 | Scaringe | F25B 49/005 |

(Continued)

FOREIGN PATENT DOCUMENTS

EP 2284448 A2 * 2/2011 ..... F04B 53/002

OTHER PUBLICATIONS http://www.inventionpartner.com/automated-ac-drainline-treatment-system-us-patent-7392658.html.

*Primary Examiner* — Marc Lorenzi
(74) *Attorney, Agent, or Firm* — Mark Malek; Jonathan Staudt; Widerman Malek, PL

(57) ABSTRACT

A drain line cleaning system including a housing, a pump carried by the housing, a line cleaning agent carrying tube in communication with the pump, a controller in communication with the pump, and a power supply carried by the housing and connected to the pump and the controller. The line cleaning agent carrying tube includes an intake that is connectable to a reservoir that carries line cleaning agent and an output that is connectable to a drain line. The controller controls the pump to function to withdraw the line cleaning agent from the reservoir and causes the line cleaning agent to be expelled through the output.

6 Claims, 10 Drawing Sheets

(56) References Cited

U.S. PATENT DOCUMENTS

2010/0326475 A1* 12/2010 Ku ..... B08B 9/0328
134/22.12
2011/0308546 A1* 12/2011 Kaiser ..... F24F 13/222
134/18

* cited by examiner

DRAIN LINE CLEANING SYSTEM

FIELD OF THE INVENTION

The present invention relates to systems for cleaning HVAC drain lines. More specifically, the present invention relates to an automated system to injection cleaning fluid into a drain line upon detection of a dog or as desired.

BACKGROUND OF THE INVENTION

Every year millions of dollars are spent to repair the damage done from clogged and overflowing evaporator drain lines and pans. The average air conditioning unit produces between five and eight gallons a day of condensate when in operation. If the drain line is clogged, it does not take long to overflow the drain pan and cause considerable damage to flooring, ceiling, carpet, as well as possible damage to adjacent housing units. There also can be significant cost from mold and mildew damage. This damage often is not covered by insurance.

The key to prevention is having the drain lines treated on a regular basis with bleach or some other biocide fluid. The problem is getting the treatment done on a regularly scheduled basis. According to the UN Atlas of the Oceans, forty-four percent of the world's population lives within 150 kilometers of a coastline. In the United States, around fifty-three percent of the population lives within 50 miles of the oceans, and since 1970 there have been approximately 2000 homes per day erected in coastal areas. This means that there is an ever-increasing number of homes which are subjected to high humidity and need algae protection for their air conditioner evaporator drain lines.

Prior art devices for dealing with the algae build-up in the evaporator portion of the air conditioning unit have several limitations. Many known devices add a trickle amount of biocide to the drain pan of the evaporator on a continuous basis or on an intermittent but frequent basis. This small amount of flow over the large area of the drain pan results in a very low flow velocity, which is insufficient to wash away any solids. Because the biocide is added on a continuous basis (or on an intermittent but frequent basis), the storage tank holding the biocide is quickly depleted, requiring frequent refilling by the user. In such a device, the biocide is present on a continuous basis over the large exposed area of the drain pan. This results in objectionable odors during operation, as well as the presence of fumes which may damage parts of the air conditioning unit.

Other known devices, such as the one presented in U.S. Pat. No. 7,392,658 incorporate a valve to release a cleaning agent on a less frequent basis but relies on gravity to feed the cleaning agent through the valve and into the drain pipe. This severely limits the utilization of the device as such a configuration is not always possible or practical.

Therefore, a need exists for a system suitable for a wide number of installations, which provides cleaning agent as required.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a drain line cleaning system which may include a housing, a pump carried by the housing, a line cleaning agent carrying tube, a controller in communication with the pump, and a power supply carried by the housing and connected to the pump and the controller. The line cleaning agent carrying tube may be in communication with the pump and may include an intake, which may be connectable to a reservoir that carries line cleaning agent, and an output, which may be connectable to a drain line. The controller may control the pump to function to withdraw the line cleaning agent from the reservoir and cause the line cleaning agent to be expelled through the output.

The line cleaning agent carrying tube may include a first portion connected to and extending outwardly from the pump, a second portion in communication with the first portion and adapted to be in fluid communication with the reservoir, and a third portion in communication with the first portion and adapted to be in communication with a drain line. The line cleaning agent carrying tube may also include a valve that connects the first portion, the second portion and the third portion. The valve may be configured to allow for the line cleaning agent to be withdrawn from the reservoir via the second portion and deposited to the drain line vial the third portion so that flow of the line cleaning agent is only in a direction from the reservoir to the drain line.

The valve may be a Y-valve, and the pump may be a rotary pump. The drain line cleaning system may include an interface configured to be connected to an external power supply. The drain line cleaning system may include a wireless transceiver in communication with the controller. The wireless transceiver may be adapted to be positioned in communication with a global communication network and may be adapted to receive a command from another device in communication with the global communication network.

The drain line cleaning system may include a reservoir level sensor to sense a level of the line cleaning agent in the reservoir. The controller may be adapted to send a signal through the global communications network to a connected device indicating a low level of line cleaning agent in the reservoir. The controller may be operable to control the pump to dispense the line cleaning agent upon receipt of a command from a device that is connected to the global communication network. The drain line cleaning system may include a timer in communication with the controller. The pump may be operable based on a signal from the timer.

The drain line cleaning system may also include a clog sensor in communication with the controller to sense a clog in the drain line. The pump may be controllable to at least one of (1) dispense a burst of air responsive to a signal received from the clog sensor indicating that a clog is sensed in the drain line and (2) dispense a predetermined amount of line cleaning agent responsive to a signal received from the clog sensor indicating that a clog is sensed in the drain line.

BRIEF DESCRIPTION OF THE DRAWINGS

Some embodiments of the present invention are illustrated as an example and are not limited by the figures of the accompanying drawings, in which like references may indicate similar elements.

DETAILED DESCRIPTION OF THE INVENTION

Figure 1:
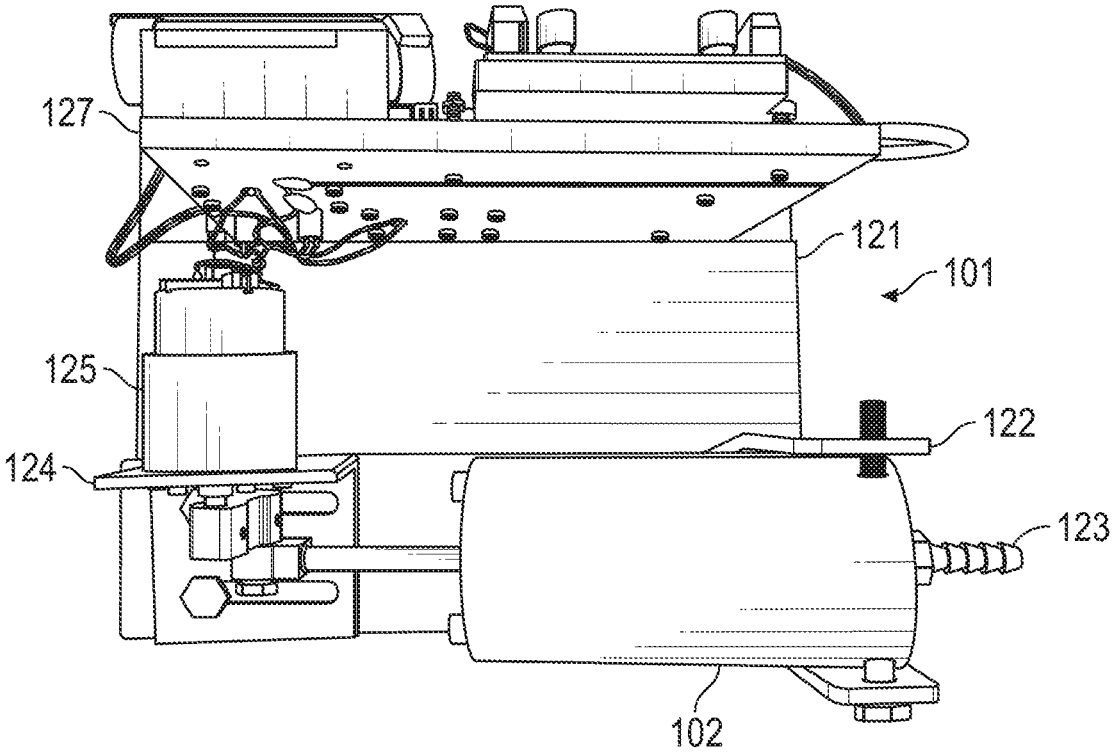
FIG. 1 is a top plan view of a drain line cleaning system according to an embodiment of the present invention.
Figure 2:
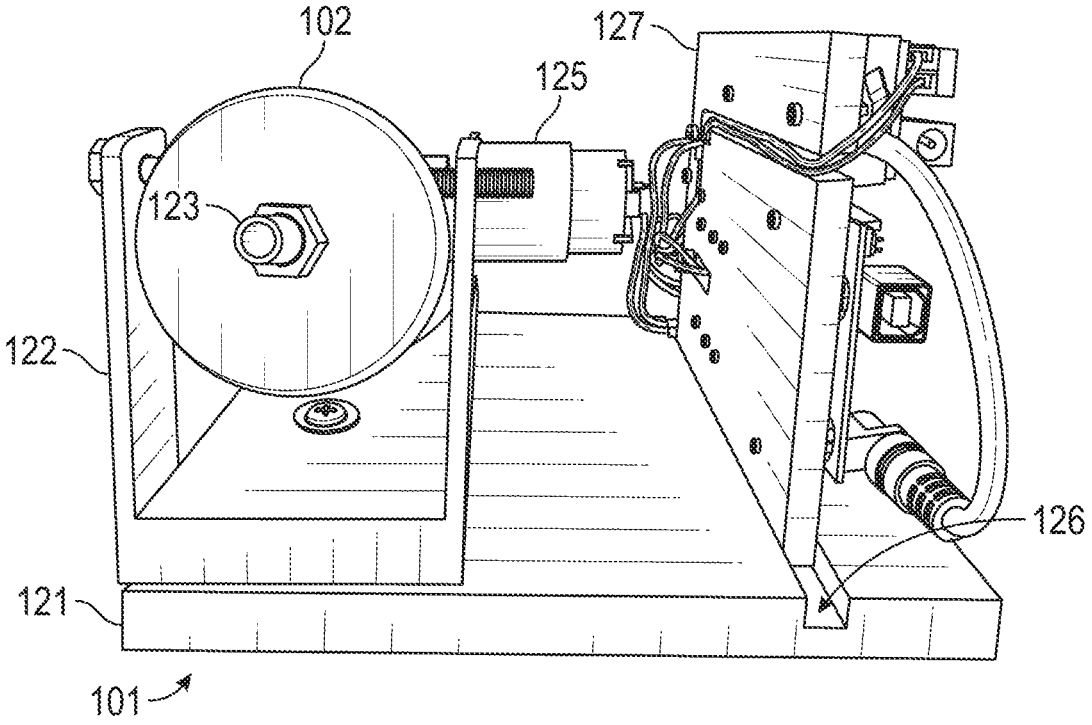
FIG. 2 is a first side perspective view of the drain line cleaning system of FIG. 1.
Figure 3:
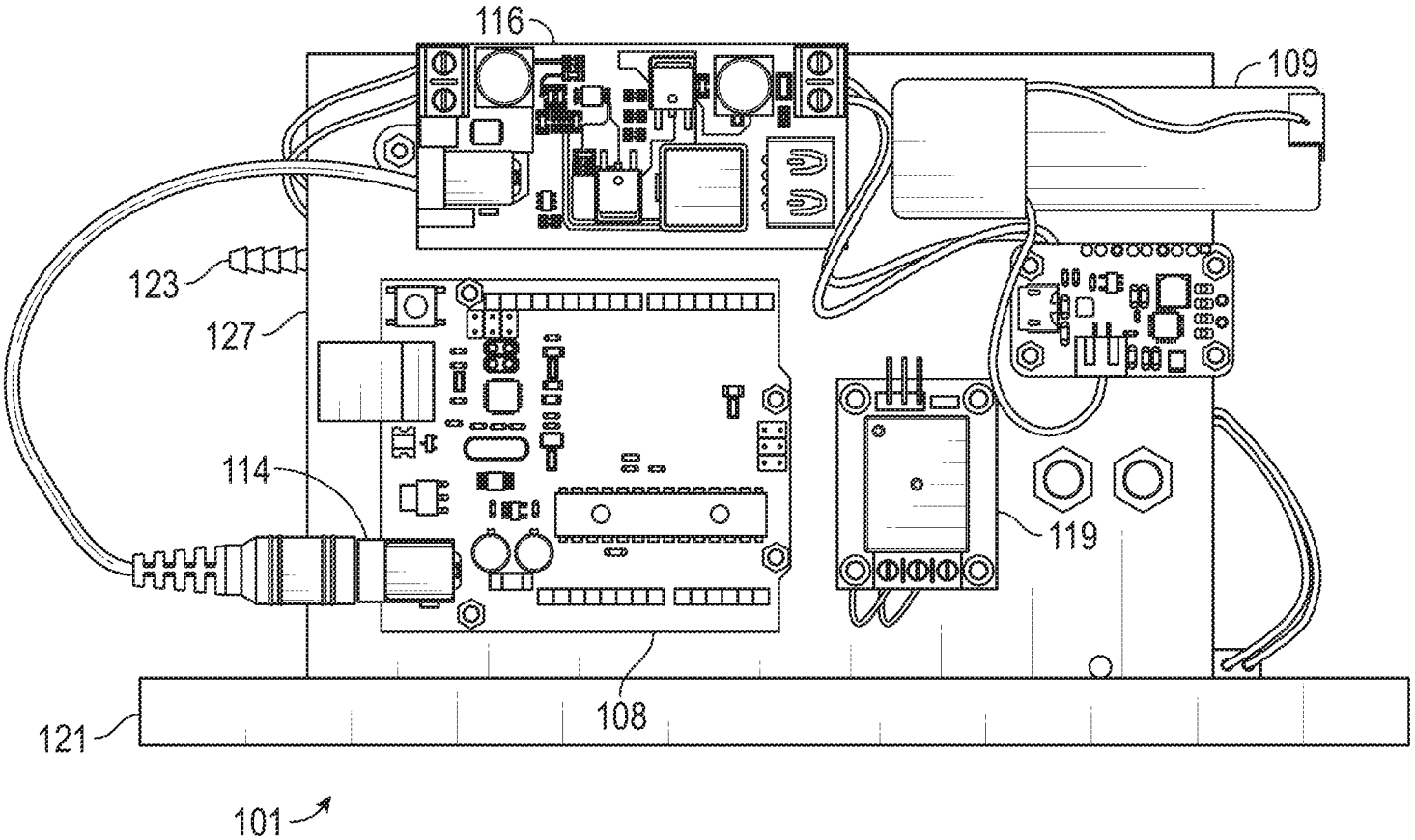
FIG. 3 is a rear elevation view of the drain line cleaning system of FIG. 1.
Figure 4:
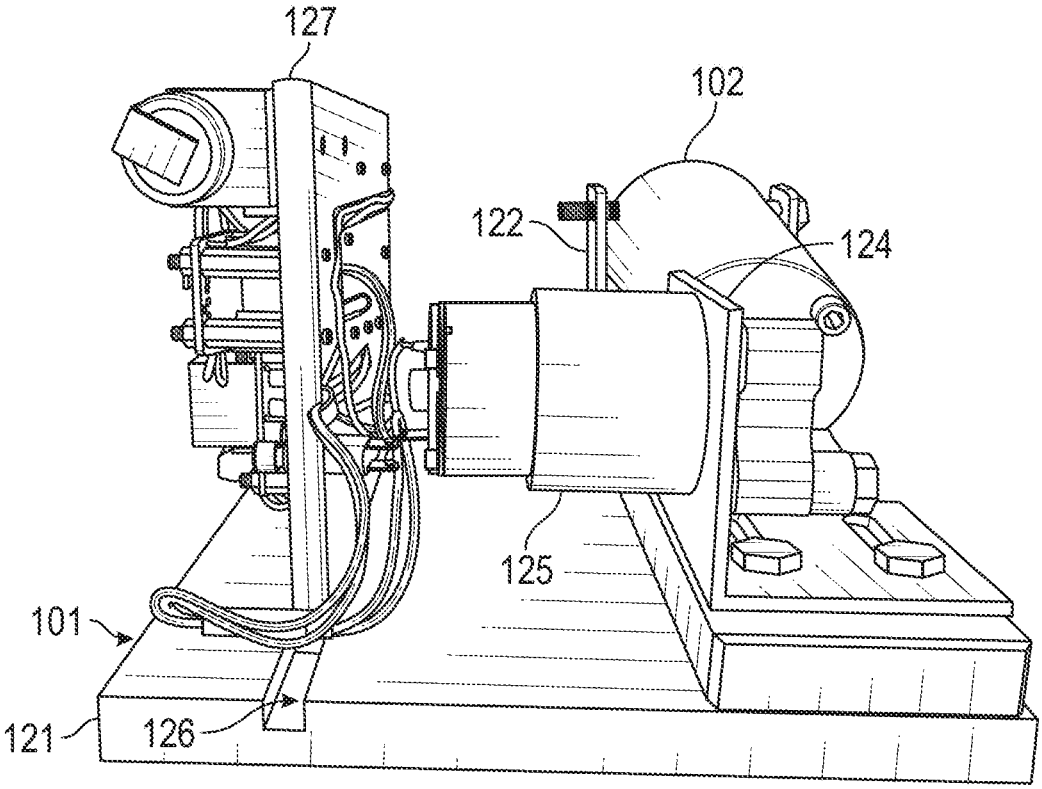
FIG. 4 is a second side perspective view of the drain line cleaning system of FIG. 1.
Figure 5:
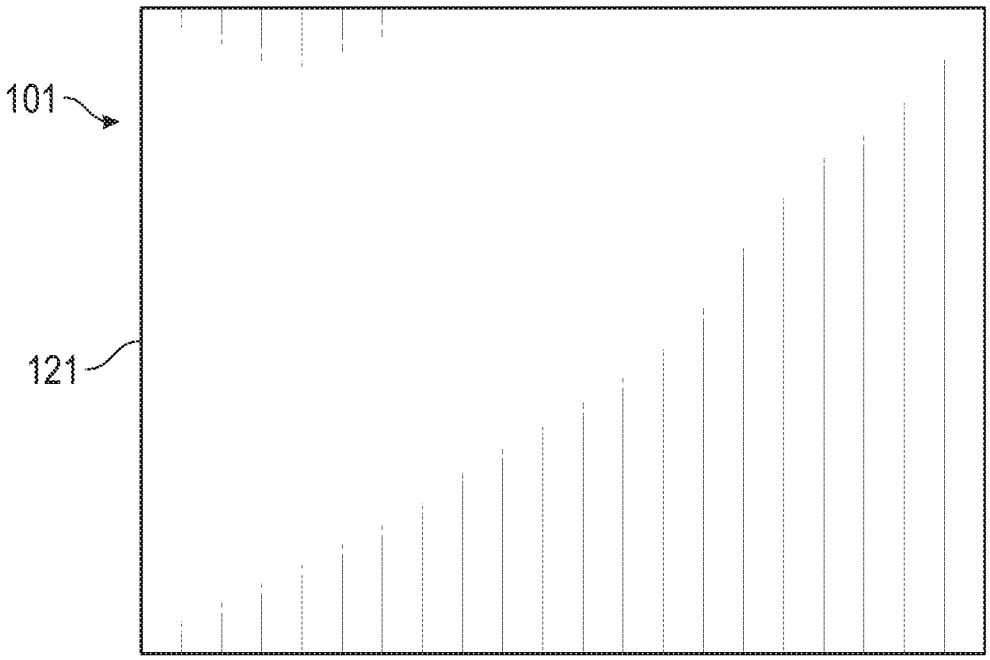
FIG. 5 is a bottom plan view of the drain line cleaning system of FIG. 1.
Figure 6:
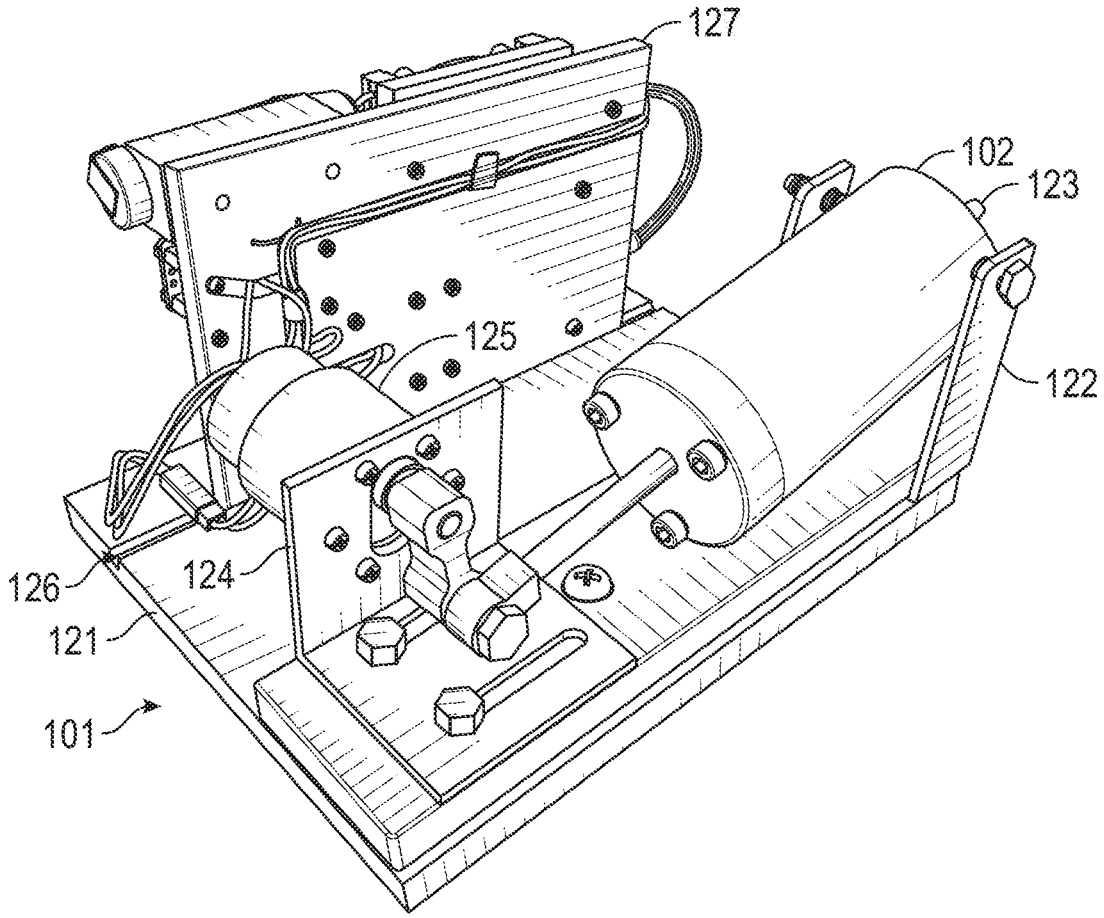
FIG. 6 is a perspective view of the drain line cleaning system of FIG. 1.
Figure 7:
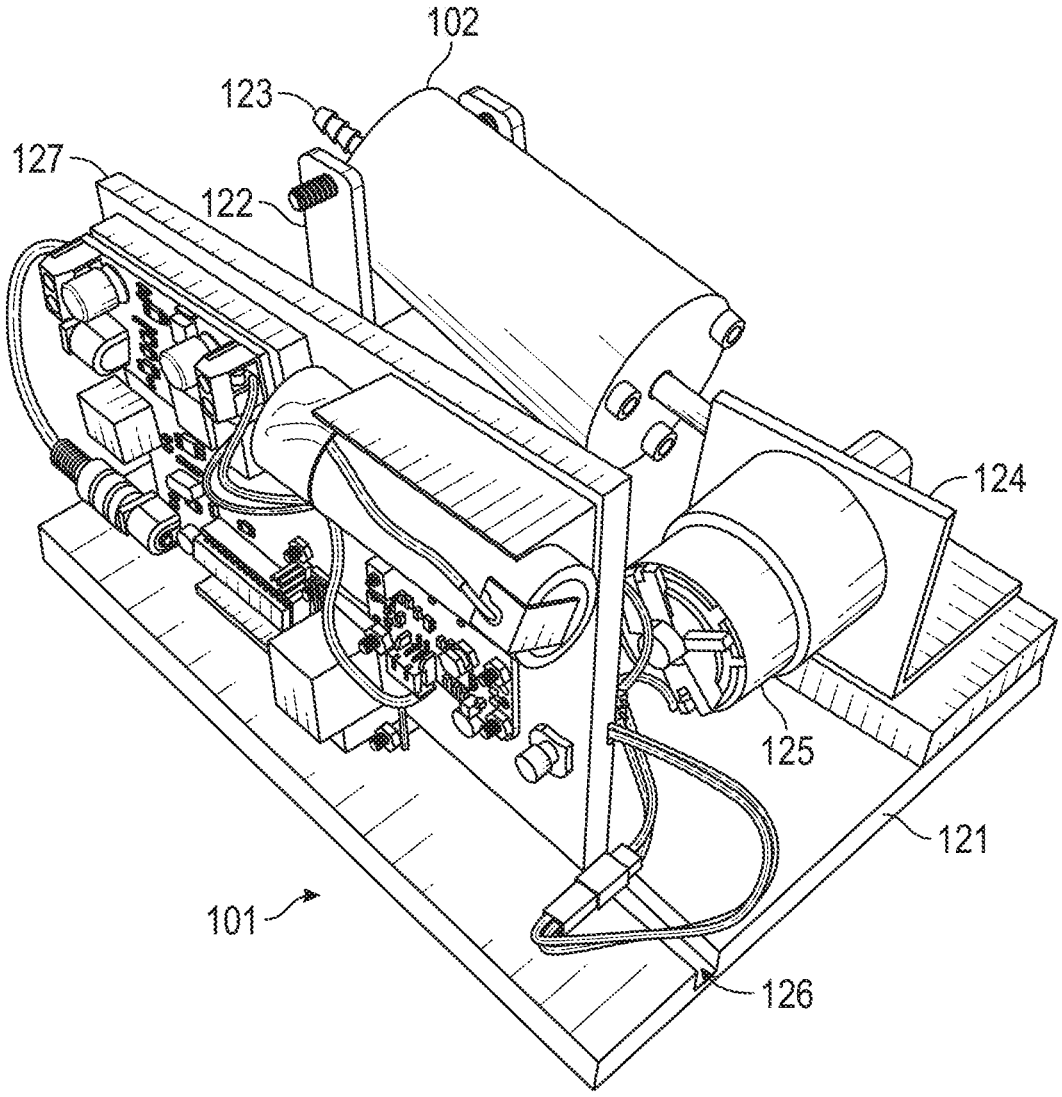
FIG. 7 is a perspective view of the drain line cleaning system of FIG. 1.
Figure 8:
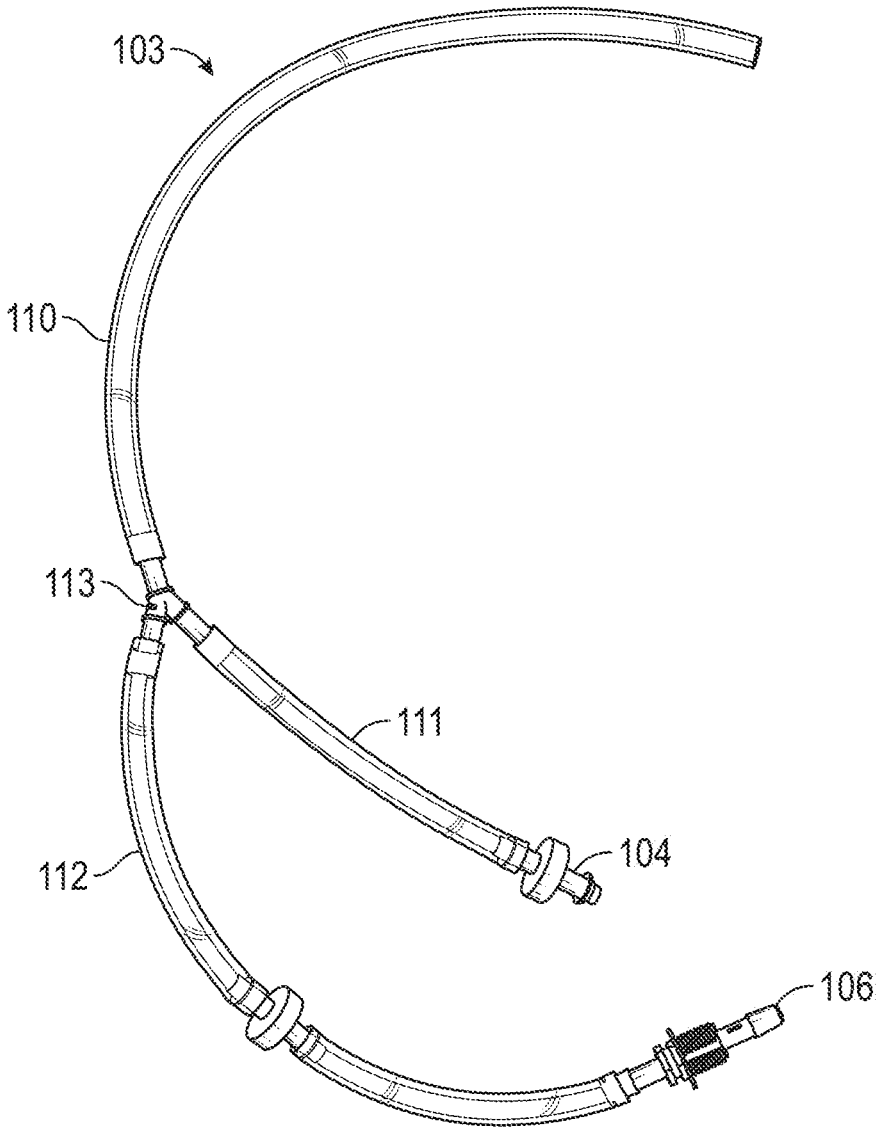
FIG. 8 is a perspective view of a line cleaning agent carrying tube of the drain line cleaning system according to an embodiment of the present invention.
Figure 9:
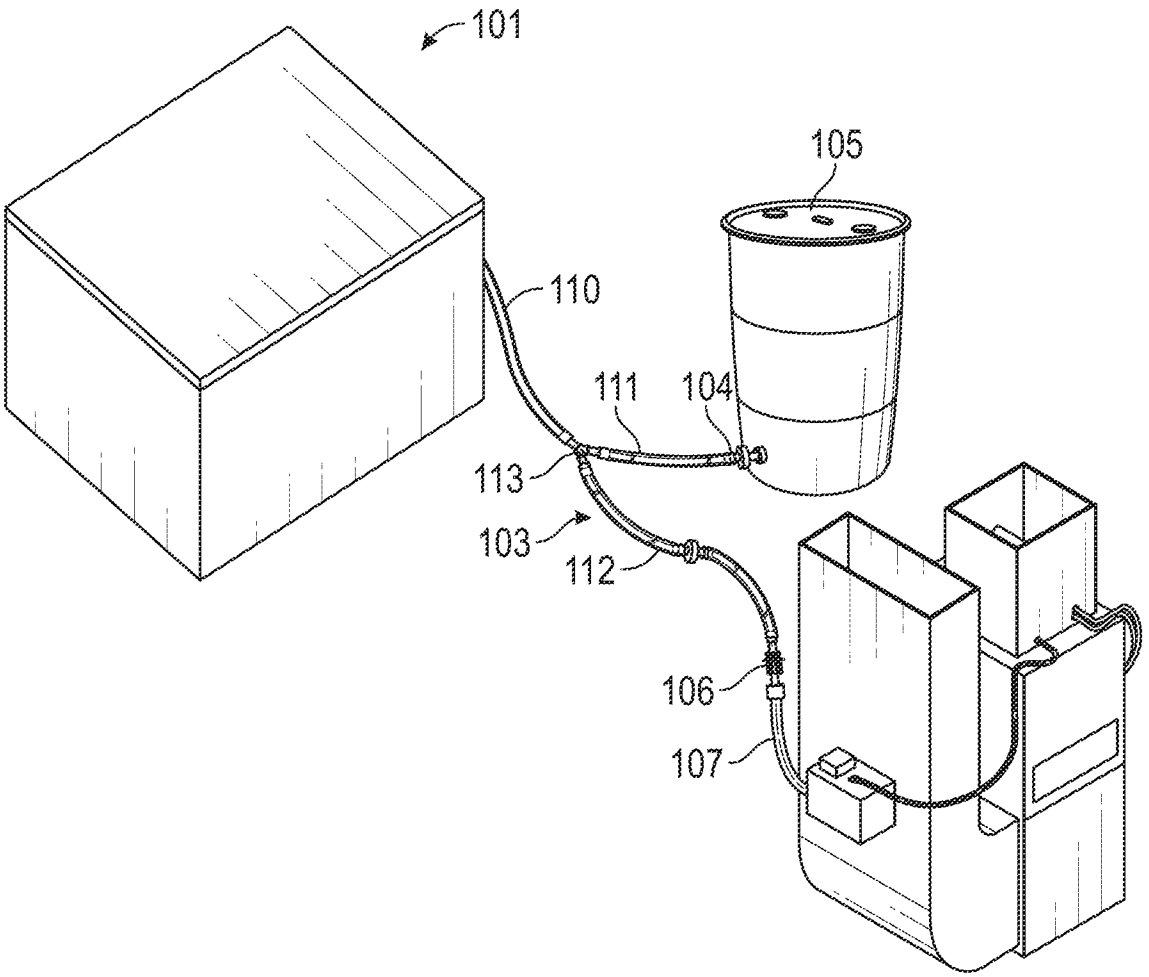
FIG. 9 is a perspective view of the drain line cleaning system according to an embodiment of the present invention.
Figure 10:
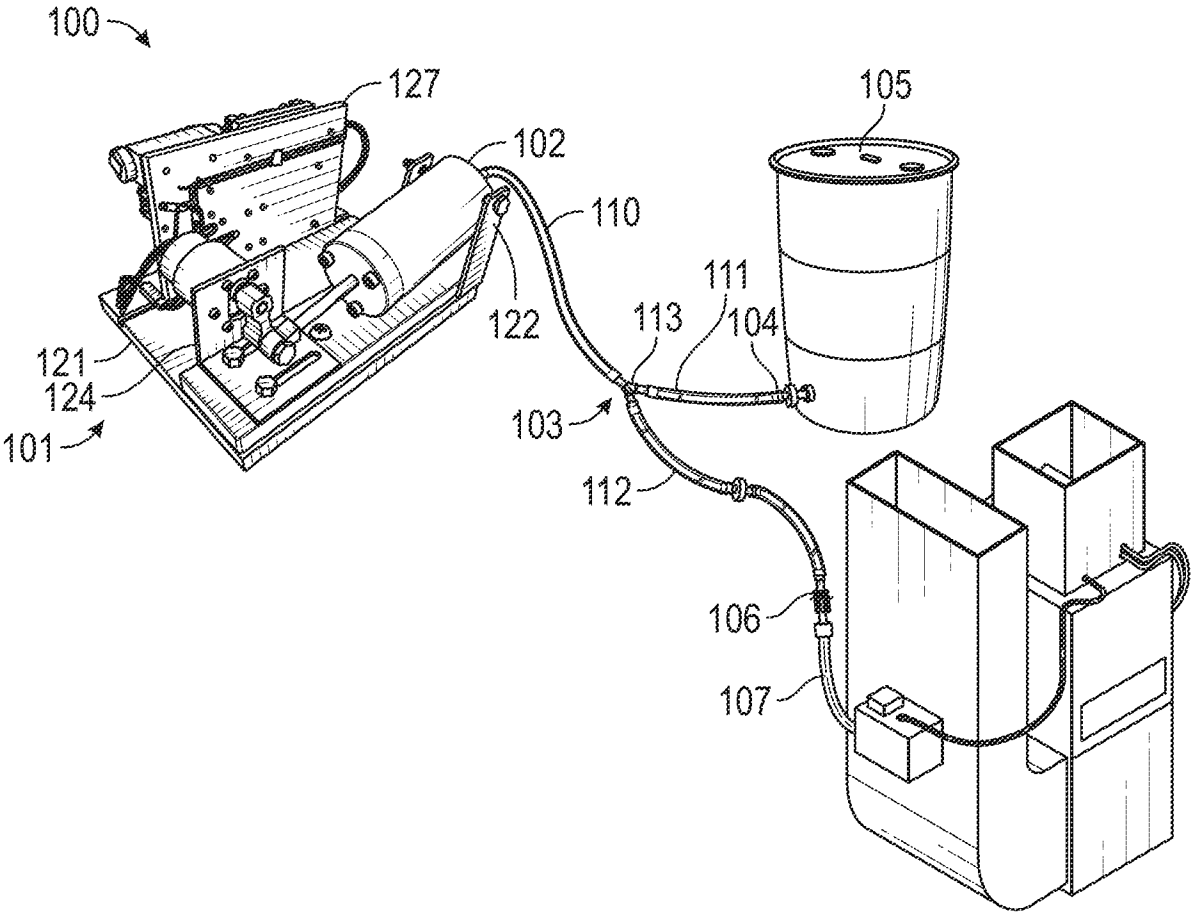
FIG. 10 is a perspective view of the drain line cleaning system according to an embodiment of the present invention.
Figure 11:
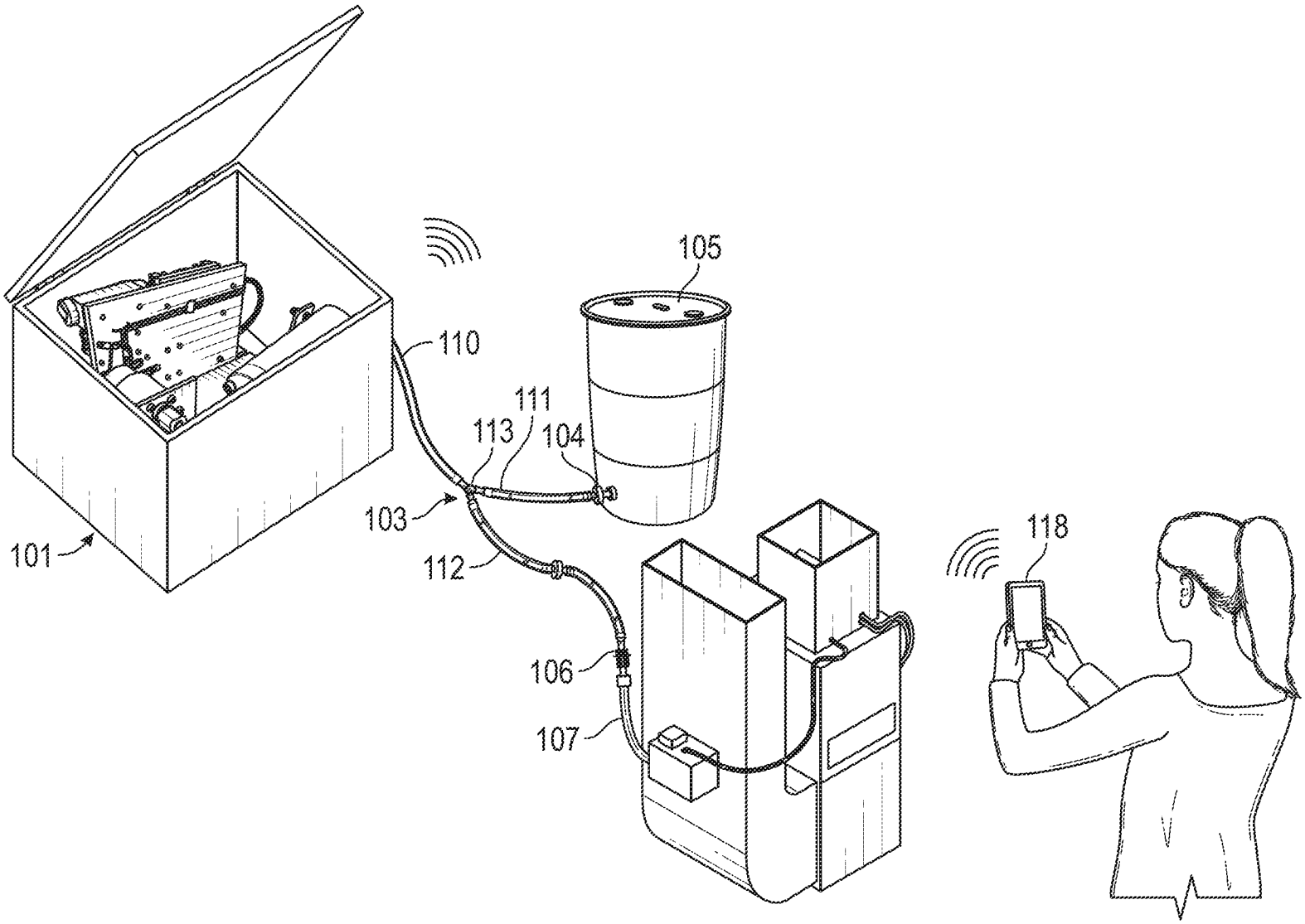
FIG. 11 is a perspective view of the drain line cleaning system according to an embodiment of the present invention.
Figure 12:
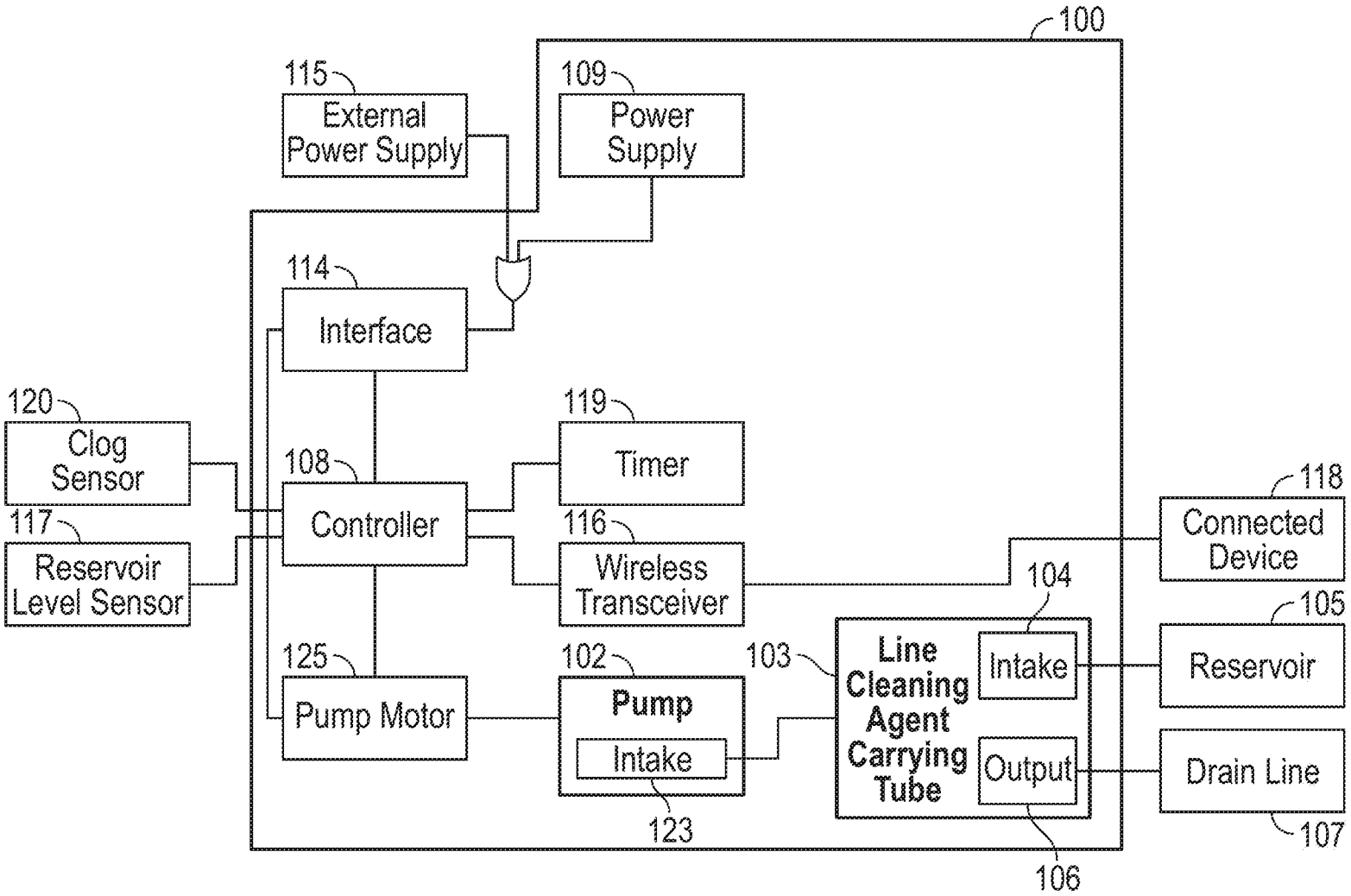
FIG. 12 is a schematic view of the drain line cleaning system according to an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a drain line cleaning system 100 including a pump 102, a controller 108, and a power supply 109. The drain line cleaning system 100 may also include a housing 101, a line cleaning agent carrying tube 103, a pump motor 125, a wireless transceiver 116, a timer 119, and an interface 114.

The housing 101 may be configured to carry the pump 102, the controller 108, and the power supply 109. In one embodiment, the housing 101 may include a base 121. The base 121 may have opposing planar surfaces. A bottom surface may rest on the ground or be supported by another object. The upper surface may carry components of the drain line cleaning system 100. A cradle 122 may be secured to the upper surface of the base 121. The cradle 122 may include two elongate members extending upward away from the upper surface. In one embodiment, the two elongate members may be secured to one another proximate the base 121 with a third member extending between the two elongate members to form a U shape. The cradle 122 may be adapted to carry the pump 102 between the two elongate members. In one embodiment, the cradle 122 may be positioned proximate an edge of the base 121. The pump 102 may be carried by the cradle 122 to position a first end of the pump 102 proximate the edge of the base 121, with an intake 123 of the pump 102 proximate to or extending beyond the perimeter of the base 121.

An additional elongate member 124 may extend upward from the base 121. This elongate member 124 may be a portion of an L-bracket secured to the base 121. The elongate member 124 may be secured to the base proximate a second end of the pump 102 and may be adapted to carry a pump motor 125 on a first side, which engages with the pump 102 located on an opposing second side of the elongate member 124. Both the elongate member 124 and cradle 122 may be mounted to a riser secured directly to an upper surface of the base 121.

In one embodiment, the base 121 may include a groove 126 extending across an entirety of a length of the base 121 from a first side to a second side. The groove 126 may be about half a thickness of the base 121 and be adapted to receive a thickness of a controller mount 127. The controller mount 127 may be received by the groove 126 and extend upwardly, perpendicular to the upper surface of the base 121. A first side of the controller mount 127 may oppose the pump motor 125 and pump 102. A second side of the controller mount 127 may oppose the first side of the controller mount 127 and face the pump 102 and pump motor 125.

The controller mount 127, elongate member 124, riser, and cradle 122 may be fixedly secured to the base 121. The housing 101 may have a cover adapted to fit around the perimeter of the base 121 or rest upon the base 121 along a perimeter of the base 121. The cover in combination with the base 121 may be adapted to enclose the power supply 109, controller 108, wireless transceiver 116, timer 119, pump 102, and pump motor 125 within the housing 101. The intake 123 of the pump 102, line cleaning agent carrying tube 103, clog sensor 120, and reservoir level sensor 117 may be outside of the housing. More specifically, the line cleaning agent carrying tube 103 may be partly carried within the housing to connect to the pump 102 and extend out of the housing to be in communication with the reservoir and the drain line.

A line cleaning agent carrying tube 103 may be in communication with the pump 102. In one embodiment, the line cleaning agent carrying tube 103 may have a first portion 110 with a first and second end, a second portion 111 with a first and second end, and a third portion 112 with a first and second end. A valve 113 may be secured to the second end of the first portion 110, the second end of the second portion 111, and the second end of the third portion 112. The valve 113 may place the second portion 111 in communication with the first portion 110, the third portion 112 in communication with the first portion 110, and the second portion 111 in communication with the third portion 112. The first end of the second portion 111 may include an intake 104 connectable to a reservoir 105. The reservoir 105 may be adapted to carry a line cleaning agent, which may be a cleaning solution, including, but not limited to, a biocide suitable for cleaning algae or other organic material from the drain line. The first end of the third portion 112 may include an output 106 connectable to a drain line 107.

The pump 102 may be operable to draw the line cleaning agent into the line cleaning agent carrying tube 103 from the reservoir 105 via the intake 105 and deposit the line cleaning agent into the drain line 107 via the output 106. In one embodiment, the pump 102 may be a rotary pump.

The valve 113 may direct the flow of the line cleaning agent only through the second portion 111 and third portion 112 of the line cleaning agent carrying tube 103 and prevent line cleaning agent from entering the first portion 110 of the line cleaning agent carrying tube 103. The valve 113 may direct the flow of line cleaning agent only in a direction from the reservoir 105 to the drain line 107 when the pump 102 creates negative pressure within the line cleaning agent carrying tube 103. The valve 113 may direct the flow of air only in a direction from the pump intake 123 to the drain line 107 when the pump 102 creates positive pressure within the line cleaning agent carrying tube 103. In one embodiment, the valve 113 may be a Y-valve.

A controller 108 may be secured to the first side of the controller mount 127, be in electrical communication with the pump 102, and be configured to control operation of the pump 102. The controller 108 may send one or more signals to the pump motor 125, which may actuate the pump motor 125 and cause the pump 102 to create either positive or negative pressure within the line cleaning agent carrying tube 103. Positive pressure may cause air to be injected into the drain line 107 while negative pressure may cause cleaning agent to travel from the reservoir 105 to the drain line 107.

A power supply 109 may be secured to and carried by the first side of the controller mount 127 and in electrical communication with the pump 102 via the pump motor 125, which may be a part of the pump 102. The power supply 109 may also be in electrical communication with the controller 108. The controller 108 may include an interface 114 to which an external power supply 115 may be connected. In one embodiment, power provided by the power supply 109 or power provided by an external power supply 115 may be connected to the interface 114 to power the drain line cleaning system 100.

A wireless transceiver 116 may be in electrical communication with the controller 108. The wireless transceiver 116 may also be in communication with a global communication network, including, but not limited to, a cellular network. The wireless transceiver 116 may receive data from a connected device 118, which is also in the global communication network. By way of example, and not as a limitation, the wireless transceiver 116 may receive one or more commands from a connected device 118, which may be, by way of example, and not as a limitation, a cell phone or the like. The one or more commands may include, but are not limited to, "inject cleaning agent" and "inject air." In an embodiment in which the wireless transceiver 116 receives an "inject cleaning agent" command, this command may be provided to the controller 108, which may actuate the pump motor 125 to direct cleaning agent to be moved from the reservoir 105, through the line cleaning agent carrying tube 103 to the drain line 107. In an embodiment in which the wireless transceiver 116 receives an "inject air" command this command may be provided to the controller 108, which may actuate the pump motor 125 to expel a burst of air through the intake 123 of the pump 102 and direct this expelled air to the drain line 107.

A reservoir level sensor 117 may be in communication with the controller 108 through a wired connection or through the wireless transceiver 116. The reservoir level sensor 117 may be adapted to sense a level of line cleaning agent contained in the reservoir 105. When the controller 108 receives a signal from the reservoir level sensor 117 indicating that the line cleaning agent level has dropped below a threshold, the controller 108 may direct the wireless transceiver 116 to send a signal to a connected device 118 indicating the low level of line cleaning agent in the reservoir 105. In some embodiments, the connected device 118 may be configured to order, purchase, or otherwise arrange for replenishment of the line cleaning agent within the reservoir 105.

The drain line cleaning system 100 may include a timer 119. The timer may be in communication with the controller 108 and may provide a "time out" signal to the controller 108 at the expiration of a duration of time. The duration of time may be programmable using a connected device 118 to provide a configuration signal to the controller 108 via the wireless transceiver 116. This configuration signal may be provided to the timer 119 to configure the duration of time at which the timer 119 will provide a "time out" signal to the controller 108. Upon receipt of the "time out" signal, the controller 108 may actuate the pump motor 125 to direct line cleaning agent to be moved from the reservoir 105, through the line cleaning agent carrying tube 103 to the drain line 107. The controller 108 may respond to a "time out" signal in a manner identical or similar to the response to the receipt of an "inject cleaning agent" signal. In one embodiment, in response to the "time out" signal, the controller 108 may actuate the pump motor 125 to direct a burst of air through the line cleaning agent carrying tube 103 to the drain line 107 in addition to, or in lieu of, directing the cleaning agent from the reservoir 105 to the drain line. The timer 119 may be configured to send a series of "time out" signals to the controller 108, with one "time out" signal sent at each expiration of the configured time duration. In this way, the controller 108 may periodically direct the injection of line cleaning agent into the drain line 107 at regular intervals.

The drain line cleaning system 100 may include a clog sensor 120. The clog sensor 120 may be in communication with the controller 108 and may provide a "clog detected" signal to the controller 108 upon detection of a clog. Upon receipt of the "clog detected" signal, the controller 108 may actuate the pump motor 125 to direct cleaning agent to be moved from the reservoir 105, through the line cleaning agent carrying tube 103 to the drain line 107 and/or may actuate the pump motor 125 to cause the pump 102 to expel a burst of air through the intake 123 of the pump 102 and direct this expelled air to the drain line 107. The controller 108 may respond to a "clog detected" signal in a manner identical or similar to the response to the receipt of an "inject cleaning agent" signal, an "inject air" signal, or both.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed:

1. A drain line cleaning system comprising:

a housing;

a pump carried by the housing;

a reservoir that carries a line cleaning agent;

a line cleaning agent carrying tube in communication with the pump, wherein the line cleaning agent carrying tube includes an intake that is connectable to the reservoir and an output that is connectable to a drain line;

a controller in communication with the pump;

a reservoir level senor connected to the reservoir to sense a level of the line cleaning agent in the reservoir;

a wireless transceiver in communication with the controller;

a clog sensor attached in communication with the controller to sense a clog in the drain line;

a connected device in communication with the wireless transceiver; and a power supply carried by the housing and connected to the pump and the controller; and wherein the controller controls the pump to function to withdraw the line cleaning agent from the reservoir and causes the line cleaning agent to be expelled through the output;

wherein the wireless transceiver is adapted to be positioned in communication with a global communication network;

wherein the reservoir level sensor is adapted to send a signal through the global communication network indicating a low level of line cleaning agent in the reservoir;

wherein the pump is controllable to dispense a predetermined amount of line cleaning agent responsive to a signal received from the clog sensor indicating that a decrease in condensate flow has been detected in the drain line;

wherein the pump can be actuated to create positive and negative pressure in the line cleaning agent carrying tube responsive to the controller;

wherein upon receipt of a sensed clog from the clog sensor, the controller causes the pump to create positive pressure in the line cleaning agent carrying tube to direct a flow of air in a direction from the pump intake to the drain line;

wherein after the flow of air is directed in the direction from the pump intake to the drain line, the controller causes the pump to create negative pressure to withdraw cleaning agent from the reservoir;

wherein after the cleaning agent is withdrawn from the reservoir, the controller causes the pump to create positive pressure to deposit the cleaning agent into the drain line;

wherein the line cleaning agent carrying tube includes a first portion connected to and extending outwardly from the pump, a second portion in communication with the first portion and adapted to be in fluid communication with the reservoir, and a third portion in communication with the first portion and adapted to be in communication with a drain line;

wherein the line cleaning agent carrying tube comprises a Y-valve that connects the first portion, the second portion and the third portion;

wherein the Y-valve is configured to allow for the line cleaning agent to be withdrawn from the reservoir via the second portion when the pump creates a negative pressure and deposited to the drain line via the third portion so that flow of the line cleaning agent is only in a direction from the reservoir to the drain line when the pump creates a positive pressure; and wherein the Y-valve allows for the pump to direct a flow of air in the direction from the pump intake to the drain line without depositing line cleaning agent into the drain line so that the air being directed into the drain line can clear a clog in the drain line.

2. The drain line cleaning system according to claim 1, wherein the pump is a rotary pump.

3. The drain line cleaning system according to claim 1, further comprising an interface configured to be connected to an external power supply.

4. The drain line cleaning system according to claim 1, wherein the wireless transceiver is adapted to receive a command from the connected device that is in communication with the global communication network.

5. The drain line cleaning system according to claim 4, wherein the controller is operable to control the pump to dispense the line cleaning agent upon receipt of a command from the connected device.

6. The drain line cleaning system according to claim 1, further comprising a timer in communication with the controller; and wherein the pump is operable based on a signal from the timer.

* * * * *